US007546719B1

(12) United States Patent
Guevara

(10) Patent No.: US 7,546,719 B1
(45) Date of Patent: Jun. 16, 2009

(54) FOUNDATION SILL SCREED HAVING TAPERING THICKNESS VERTICAL FLANGE AND ALIGNMENT GUIDE IN FRONT FACE OF VERTICAL FLANGE FOR ALIGNMENT OF SCREED WITH RESPECT TO SILL PLATE LINE

(75) Inventor: Herman Guevara, Bradenton, FL (US)

(73) Assignee: Plastic Components, Inc., Miami, FL (US)

( * ) Notice: Subject to any disclaimer, the term of this patent is extended or adjusted under 35 U.S.C. 154(b) by 176 days.

(21) Appl. No.: 11/475,600

(22) Filed: Jun. 27, 2006

(51) Int. Cl.
*E04C 2/38* (2006.01)
*E04B 1/70* (2006.01)

(52) U.S. Cl. ..... 52/716.2; 52/302.6

(58) Field of Classification Search ..... 52/58, 52/62, 293.2, 293.1, 98, 100, 59, 302.6, 716.2, 52/344, 363, 350, 364, 371
See application file for complete search history.

(56) References Cited

U.S. PATENT DOCUMENTS

| | | | | | |
|---|---|---|---|---|---|
| 1,379,516 | A * | 5/1921 | Benjamin | 52/62 |
| 1,624,121 | A * | 4/1927 | Thiem | 52/371 |
| 1,958,622 | A * | 5/1934 | Abraham | 52/60 |
| 2,969,616 | A * | 1/1961 | Gustafson | 52/255 |
| 4,391,074 | A | 7/1983 | Holsman | |
| 5,630,297 | A | 5/1997 | Rutherford | |
| 5,678,362 | A * | 10/1997 | Hulls et al. | 52/105 |
| 5,836,122 | A * | 11/1998 | Rennich et al. | 52/254 |
| 5,836,135 | A * | 11/1998 | Hagan et al. | 52/836 |
| 5,937,600 | A * | 8/1999 | Larson | 52/302.6 |
| 5,979,123 | A * | 11/1999 | Brockman | 52/101 |
| 6,293,064 | B1 | 9/2001 | Larson | |
| 6,298,609 | B1 | 10/2001 | Bifano et al. | |
| 6,385,932 | B1 | 5/2002 | Melchiori | |
| 6,397,542 | B1 * | 6/2002 | Flores | 52/365 |
| 6,470,638 | B1 * | 10/2002 | Larson | 52/302.1 |
| 6,591,559 | B2 * | 7/2003 | Contreras et al. | 52/101 |
| 6,698,144 | B1 * | 3/2004 | Larson | 52/202 |
| 6,807,786 | B1 * | 10/2004 | Peck | 52/514.5 |
| 7,383,669 | B2 * | 6/2008 | Morse | 52/545 |
| D581,060 | S * | 11/2008 | Beard, Jr. | D25/102 |
| 2006/0143994 | A1 * | 7/2006 | Allen | 52/58 |
| 2006/0150553 | A1 * | 7/2006 | Reyes et al. | 52/393 |
| 2006/0254169 | A1 * | 11/2006 | McFadden | 52/344 |
| 2007/0062137 | A1 * | 3/2007 | Maylon | 52/367 |
| 2007/0130861 | A1 * | 6/2007 | Chenier et al. | 52/371 |
| 2007/0180791 | A1 * | 8/2007 | Amster et al. | 52/741.3 |
| 2008/0016808 | A1 * | 1/2008 | Pilz | 52/302.6 |

FOREIGN PATENT DOCUMENTS

| | | | |
|---|---|---|---|
| JP | 5-112989 | * | 5/1993 |

* cited by examiner

*Primary Examiner*—Gay Ann Spahn

(57) ABSTRACT

A foundation sill screed with a vertical flange having a top end and a bottom end and a thickness that is tapered from a minimum at the top end to a maximum at the bottom end. The foundation sill screed includes a first leg extending downwardly and outwardly from the bottom end of the vertical flange, a second leg extending downwardly and inwardly from the stucco ledge, and a lip extending downwardly and inwardly from the inwardly extending member. The foundation sill screed includes a floor line alignment guide extending longitudinally along the vertical flange to provide accurate positioning of the foundation sill screed with respect to the sill plate of a building in order to properly protect the sill plate against moisture penetration and pest infestation.

8 Claims, 5 Drawing Sheets

FOUNDATION SILL SCREED HAVING TAPERING THICKNESS VERTICAL FLANGE AND ALIGNMENT GUIDE IN FRONT FACE OF VERTICAL FLANGE FOR ALIGNMENT OF SCREED WITH RESPECT TO SILL PLATE LINE

FIELD OF THE INVENTION

The present invention relates to devices for protecting the bottom edge of exterior sheathing on a structure at the point where it adjoins the foundation of the structure and more particularly to a foundation sill screed for installation at the sill plate to provide moisture control and protection against moisture penetration and pest infestation.

BACKGROUND OF THE INVENTION

Due to its inherent durability and ability to incorporate aesthetically pleasing colors textures and colors, stucco is frequently used in the construction of buildings. The stucco is used to form the exterior wall surface above the stem wall of the foundation. The stem wall, which is typically not constructed to be aesthetically appealing, is therefore normally left exposed and uncovered. When finishing buildings with stucco, it becomes necessary to establish a horizontal and straight lower edge on the stucco.

The foundation includes a footer, which is buried in the ground, and a stem wall extending upwards from the footer. A sill plate or "mud sill" typically is provided at the top of the stem wall. The sill plate serves as the bottom horizontal member of the framed portion of the building and supports the wall studs and other portions of the frame. The outer edges of the wall studs are typically aligned even with the outer surface of the stem wall. For buildings finished with stucco, a shear panel is then typically secured to the wall studs to stabilize and strengthen the walls. Since the shear panel is secured to the wall studs and the wall studs are flush with the outer surface of the stem wall, the shear panel therefore extends outward from the stem wall by an amount equal to the thickness of the shear panel.

Weep screeds are typically produced in long lengths of 10 feet or more and are commonly used to establish a straight and horizontal lower edge on the stucco layer of a building. The weep screed provides reinforcement for stucco at or below the foundation sill plate line of the building and protects the sill plate from penetration of moisture.

Although the weep screeds of the prior art provide reinforcement for stucco, as a result of being installed incorrectly, they frequently do not properly protect the sill plate area from being infiltrated by moisture. This is mainly a result of improper installation techniques. Some installers are not adequately trained in the proper procedures for installing weep screeds and this can lead to open pathways for the inward seepage of moisture or water. What is needed therefore is a foundation sill screed that can be easily and accurately positioned to protect the sill plate against penetration by moisture.

OBJECTS OF THE INVENTION

It is therefore an object of the present invention to provide a foundation sill screed with an alignment guide to enable quick and accurate installation so that the plate line or stem wall is adequately protected against moisture penetration and pest infestation.

It is another object of the present invention to provide a foundation sill screed with a tapered nailing flange to mask the juncture of the screed with the wall.

It is a further object of the present invention to provide a foundation sill screed with a bottom lip that enables compressive sealing against the outer surface of the stem wall.

SUMMARY OF THE INVENTION

According to the present invention there is provided a foundation sill screed with a vertical flange having a top end and a bottom end and a thickness that is tapered from a minimum at the top end to a maximum at the bottom end. The foundation sill screed includes a first leg extending downwardly and outwardly from the bottom end of the vertical flange, a second leg extending downwardly and inwardly from the stucco ledge, and a lip extending downwardly and inwardly from the inwardly extending member. The foundation sill screed includes a floor line alignment guide extending longitudinally along the vertical flange to provide accurate positioning of the foundation sill screed with respect to the sill plate of a building in order to properly protect the sill plate against moisture penetration and pest infestation.

TABLE OF NOMENCLATURE

Figure 1:
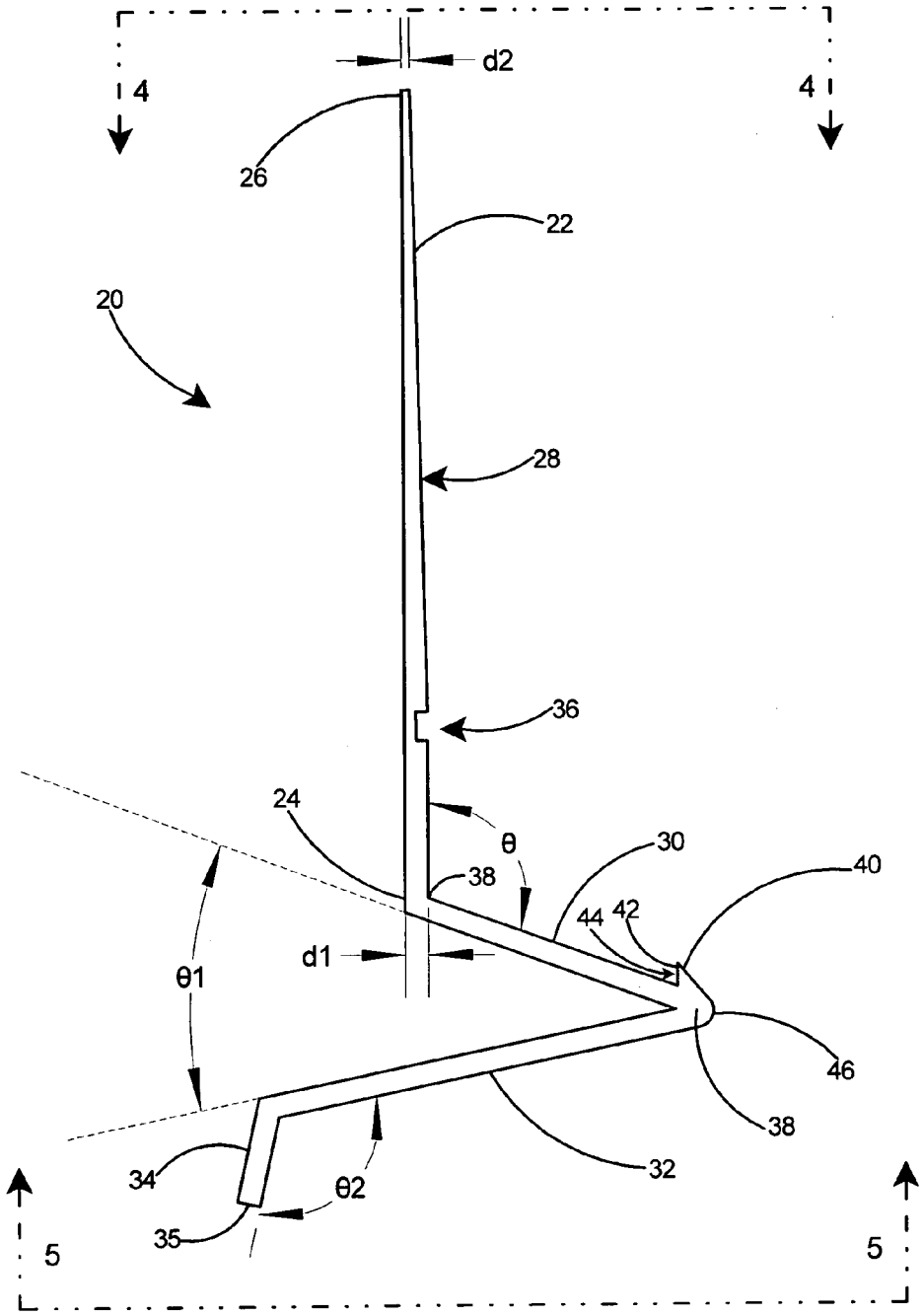
FIG. 1 is a side view of the foundation sill screed of the present invention.

The following is a listing of part numbers used in the drawings along with a brief description:

| Part Number | Description |
|---|---|
| 20 | foundation sill screed, preferred embodiment |
| 22 | vertical flange |
| 24 | bottom end of vertical flange |
| 26 | top end of vertical flange |
| 28 | front face of vertical flange |
| 30 | first leg |
| 32 | second leg |
| 34 | third leg |
| 35 | distal end of third leg |
| 36 | sill plate alignment guide |
| 38 | juncture of first and second legs |
| 40 | upward extending lip |
| 42 | inward side of lip |
| 44 | planar face |
| 46 | rounded outer edge of juncture |
| 47 | stucco |
| 48 | mounting apertures |
| 50 | weep apertures |
| 52 | juncture of first leg and vertical flange |

-continued

| Part Number | Description |
|---|---|
| 54 | second weep apertures |
| 55 | sill plate line |
| 56 | sill plate |
| 58 | top of stem wall |
| 60 | stem wall |
| 62 | bottom end of sheathing |
| 64 | sheathing |
| 66 | fastener |
| 68 | top edge of vertical flange |
| d1 | thickness of vertical flange at bottom end |
| d2 | thickness of vertical flange at top end |
| d3 | distance of bottom of vertical flange below sill plate line |
| d4 | distance from juncture of first and second legs to distal end of third leg |
| θ | angle between front face of vertical flange and first leg |
| θ1 | inside angle between first and second legs |
| θ2 | inside angle between second and third legs |

DETAILED DESCRIPTION

With reference to FIG. 1, the preferred embodiment of foundation sill screed 20 includes a vertical flange 22 having a bottom end 24, a top end 26, and a front face 28. A first leg 30 extends downwardly and outwardly from the vertical flange 22, a second leg 32 extends downwardly and inwardly from the first leg 30, and a third leg 34 extends downwardly and inwardly from the second leg 32. A sill plate alignment guide 36 extends longitudinally along the front face 28 of the vertical flange 22. The sill plate alignment guide 36 is shown as a groove in the front face 28 of the vertical flange 22 but can also be a line (not shown) placed on the front face 28 of a color contrasting the color of the front face 28. The vertical flange 22 is tapered in thickness from a maximum, shown as d1 in FIG. 1, at the bottom end 24 of the vertical flange 22 to a minimum, shown as d2, at the top end 26.

As shown in FIG. 1, the first leg 30 and the second leg 32 meet at a juncture 38 and includes a lip 40 extending upwards from the juncture 38. The upward extending lip 40 includes an inward side 42 and a planar face 44 on the inward side 42 of the lip 40. The foundation sill screed further includes a rounded outer edge 46 on the outward side of the juncture 38. The first leg 30, which will serve as a straight edge stop for stucco applied to the front face 28 of the vertical flange 22, preferably extends from the vertical flange 22 at an angle θ of between 100 and 120 degrees. The first leg 30 must be sloped downwards from the vertical flange 22 to later allow moisture, which may be absorbed within stucco (see FIG. 3), to run downward to the first leg 30 where it will accumulate and then weep outwards from first leg 30. The inside angle θ1 between the first leg 30 and the second leg 32 is preferably between 22 and 42 degrees. The second inside angle θ2 between the second leg 32 and the third leg 34 is preferably between 82 and 102 degrees.

Figure 2:
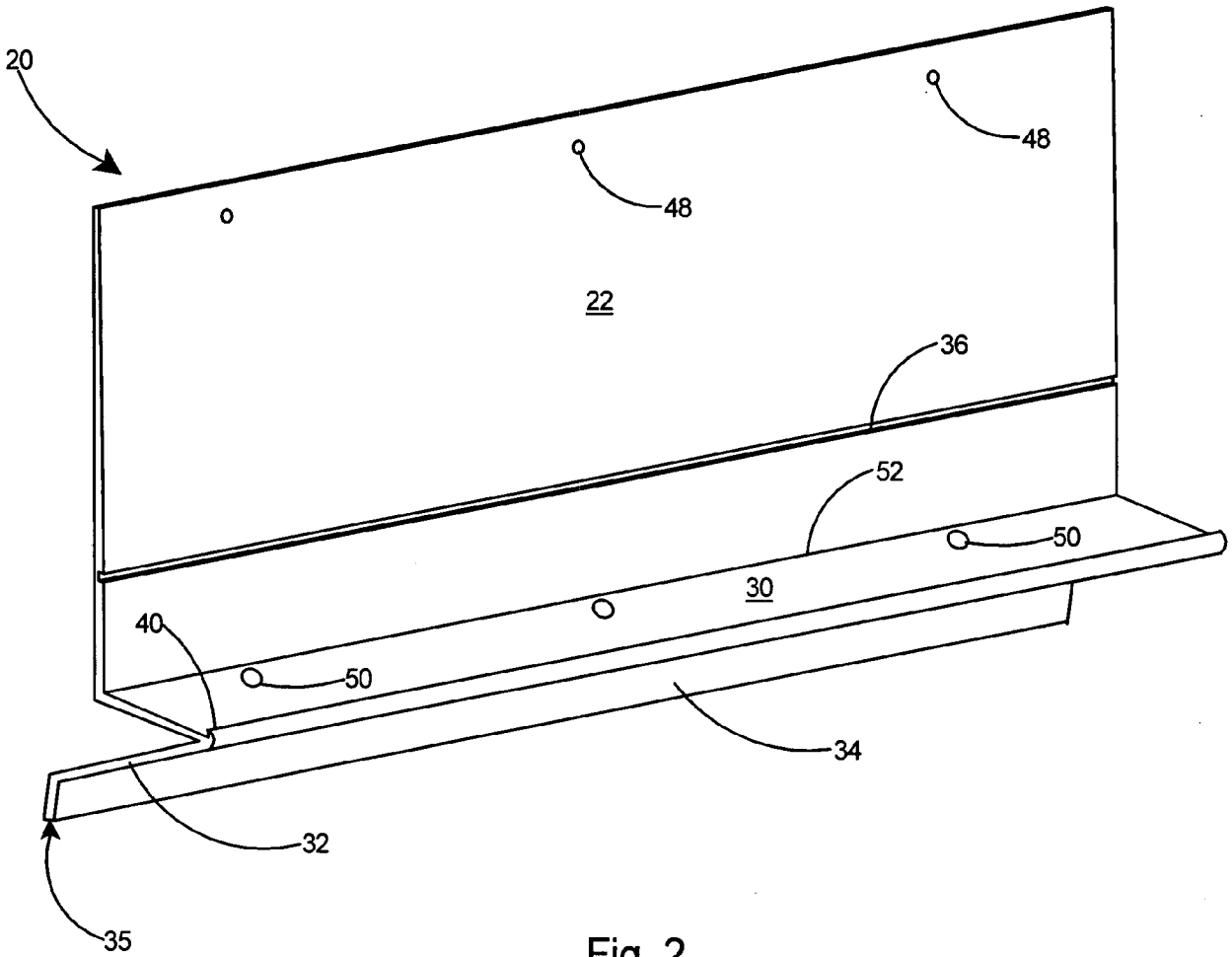
FIG. 2 is a perspective view of a representative portion of a foundation sill screed according to the present invention.

Referring to FIG. 2, the foundation sill screed 20 further includes mounting apertures 48 in the vertical flange 22. Mounting apertures 48 are provided for receiving fasteners (not shown) therethrough for later securing the foundation sill screed 20 to a building (not shown). Weep apertures 50 are also provided in the foundation sill screed 20 longitudinally along the first leg 30. The weep apertures 50 are in linear alignment along the first leg 30 and adjacent the juncture 52 of the first leg 30 with the vertical flange 22.

Figure 4:
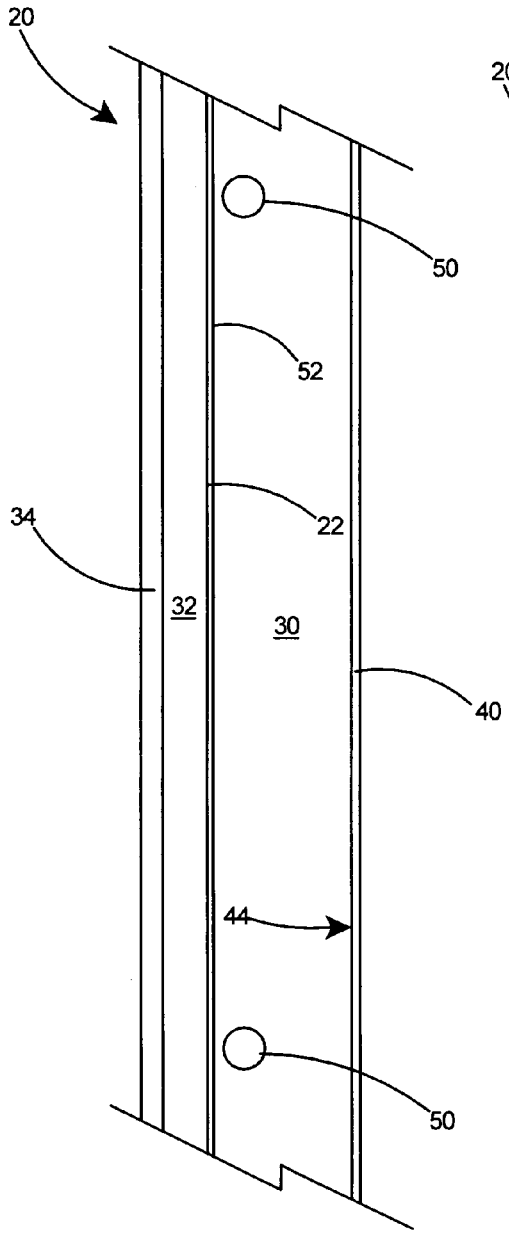
FIG. 4 is a top view of a portion of the foundation sill screed.

With reference to the top view of the foundation sill screed 20 in FIG. 4, the weep apertures 50 are depicted in linear alignment along the first leg 30 adjacent the juncture 52 of the first leg 30 with the vertical flange 22.

Figure 5:
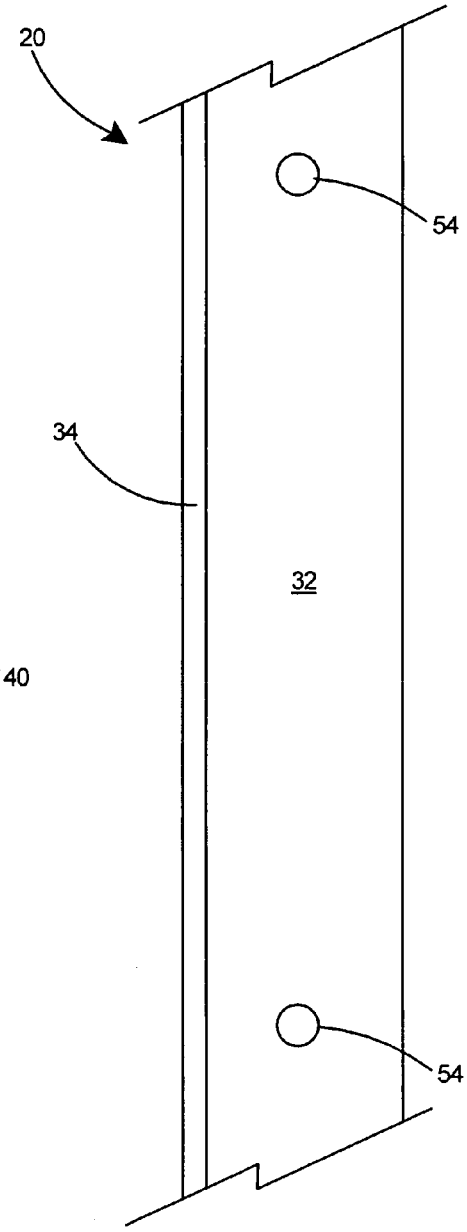
FIG. 5 is a bottom view of a portion of the foundation sill screed.

With reference to FIGS. 4 and 5, the second leg 32 includes second weep apertures 54 formed longitudinally along the second leg 32. The second weep apertures 54 in the second leg 32 are in a one to one relationship with the weep apertures 50 in the first leg 30. Each of the second weep apertures 54 in the second leg 32 is preferably in axial alignment with a corresponding weep aperture 50 in the first leg 30.

Figure 3:
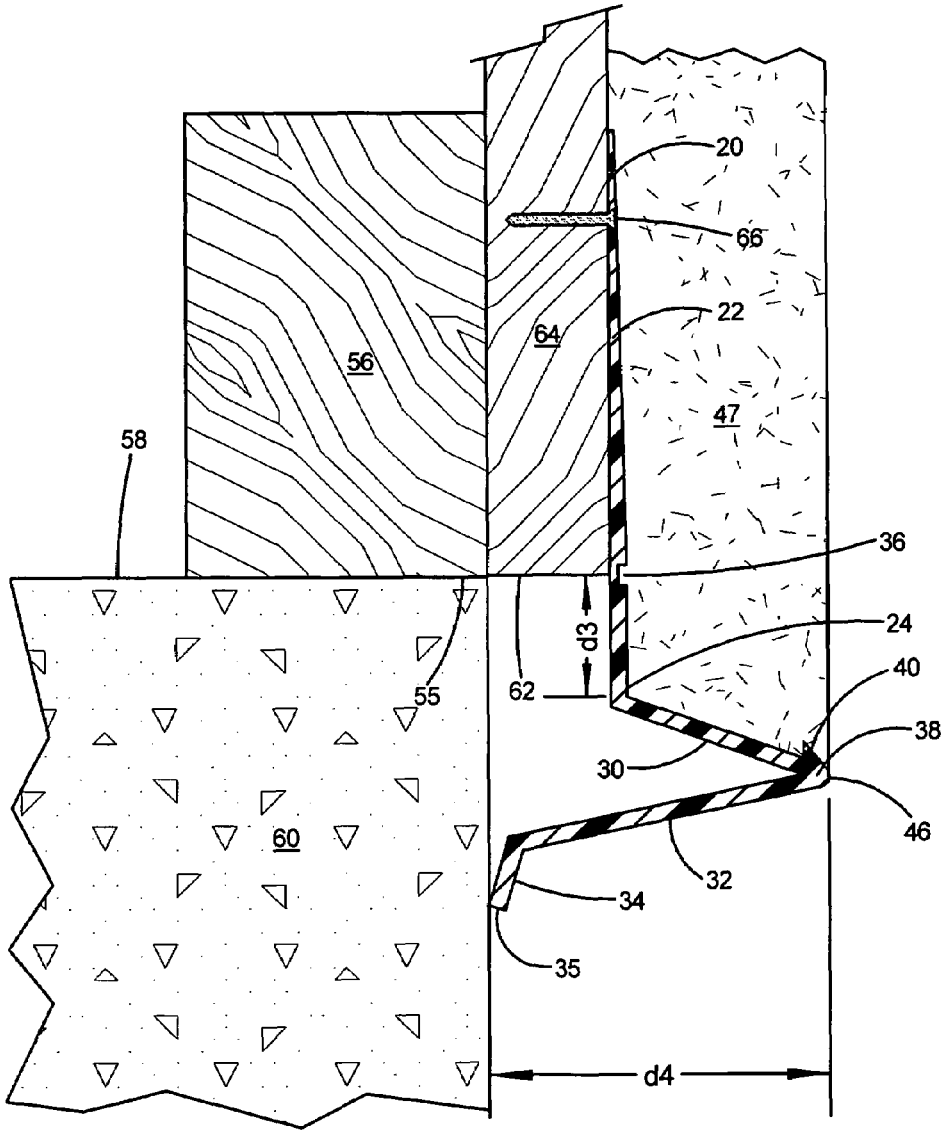
FIG. 3 is a cross-sectional view of an installation of the foundation sill screed in context of the stem wall and the sill plate of a building.

FIG. 3 depicts the foundation sill screed 20 and the area of a building at the sill plate line 55. The sill plate line 55 is located at the juncture of the sill plate 56 and the top 58 of the stem wall 60. There is depicted the bottom end 62 of sheathing 64 that has been secured to the sill plate 56. The foundation sill screed 20 is then aligned with the sill plate line 55 at each end (not shown) of the sill screed 20 and fastened to the sheathing 64 using fasteners 66. The sill plate alignment guide 36 enables the installers to rapidly and easily align the foundation sill screed 20 properly with respect to the sill plate line 55. To properly protect the sill plate line 55, the bottom 24 of the vertical flange 22 must terminate at or below the bottom of the sill plate 56 or the bottom end 62 of the sheathing 64. Preferably the sill plate alignment guide 36 positions the bottom 24 of the vertical flange 22 at distance d3 below the sill plate line 55. Positioning the foundation sill screed 20 with the sill plate alignment guide 36 ensures that the sill screed 20 will properly protect the sill plate 56 from rain or moisture. Preferably distance d3, the distance between the bottom 24 of the vertical flange 22 and the center of the sill plate alignment guide 36, is between 0.25 and 1.0 inch.

Preferably second leg 32 extends inward beyond vertical flange 22 as shown in FIG. 3. The third leg 34 extends downward and inward from the second leg 32 and terminates in distal end 35. The distance d4 from the rounded outer edge 46 of juncture 38 to distal end 35 of third leg 34 therefore is sized such that third leg 34 contacts the stem wall 60 and is biased slightly outward by the stem wall 60. This insures a tight fit of the distal end 35 against the stem wall 60. For 0.5 inch thick sheathing 64, distance d4 is preferably between 1.1 and 1.4 inch. The length of the second leg 32 can be varied to accommodate sheathing of a different thickness. Positioned as shown in FIG. 3, the foundation sill screed 20 of the present invention protects the sill plate 56 and the bottom end 62 of the sheathing 64 from moisture, water splashing or spraying upwards from rain or irrigation equipment, and some protection against pest infestation.

Figure 6:
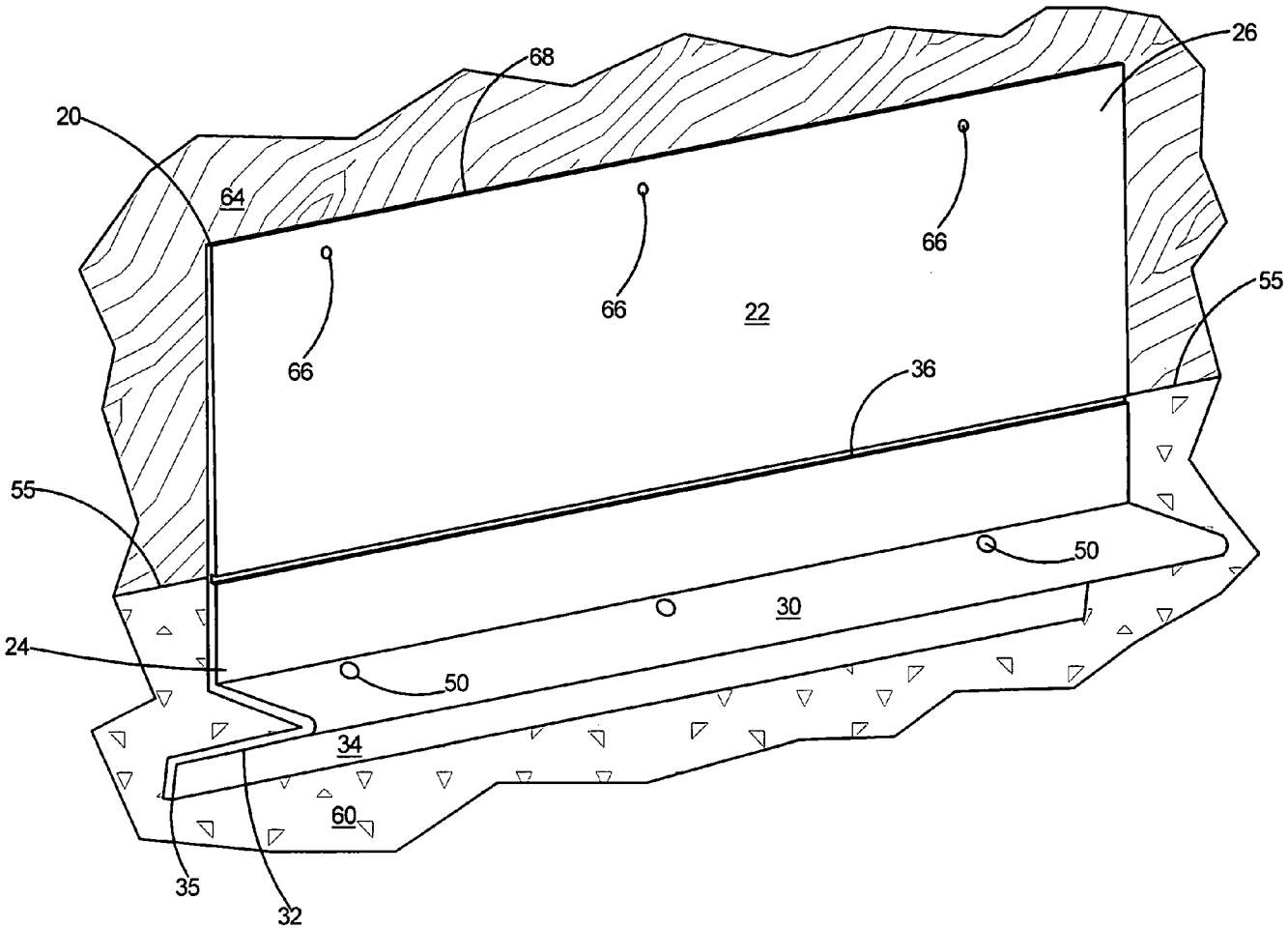
FIG. 6 is a perspective view of a representative portion of a foundation sill screed, with the portion shown installed on a building and in proper alignment with the sill plate of the building.

FIG. 6 depicts a perspective view of the foundation sill screed 20 of the present invention installed at the sill plate line 55. The foundation sill screed 20 has been fastened to the sheathing 64 by fasteners 66 such as nails. Distal end 35 of third leg 34 contacts stem wall 60. The foundation sill screed 20 has been properly positioned and installed by use of the sill plate alignment guide 36, which properly aligns the foundation sill screed 20 with respect to the sill plate line 55. It should be noted that the foundation sill screed 20 is typically provided in long lengths such as 10 feet or more, and the alignment guide 36 therefore provides a very important mechanism for quickly aligning the sill screed 20. With the vertical flange 22 tapering to a minimal thickness at the top end 26, the top edge 68 of the vertical flange 22 will advantageously not create much of a step change at the top edge 68. Typically, after installation of the foundation sill screed 20, a moisture barrier and lath (not shown) are typically laid over the surface of the building and over the vertical flange. Stucco, as shown in FIG. 3, is then applied over the lath.

While the foundation sill screed 20 of the present invention can be manufactured from a wide variety of materials including metals such as aluminum or copper, it is preferred for purposes of cost and ease of manufacture that it be fabricated from an extrudable polymeric material such as polyvinyl chloride or the like.

As the invention has been described, it will be apparent to those skilled in the art that the same may be varied in many ways without departing from the spirit and scope of the invention. Any and all such modifications are intended to be included within the scope of the appended claims.

What is claimed is:

1. A foundation sill screed for protecting the sill plate line of a building against penetration by moisture comprising:

a vertical flange having a bottom end, a top end, and a front face, said vertical flange is tapered in thickness from a maximum at said bottom end of said vertical flange to a minimum at said top end of said vertical flange;

a first leg extending downwardly and outwardly from said vertical flange, said first leg including weep apertures therein;

a second leg of uniform thickness extending downwardly and inwardly from said first leg, said second leg including second weep apertures therein;

a third leg extending downwardly and inwardly from said second leg;

said first leg and said second leg meet at a juncture, said juncture of said first leg and said second leg including a rounded outer edge;

a lip extending upwards from said juncture, said lip including an inward side and a planar face on said inward side;

a sill plate line alignment guide intermediate said top end and said bottom end of said vertical flange extending longitudinally along said front face of said vertical flange; and said sill plate alignment guide is a single groove in said front face of said vertical flange, wherein said alignment guide forms a visual reference for aligning said foundation sill screed with the sill plate line and positions a substantial portion of said vertical flange below the sill plate line.

2. The foundation sill screed of claim 1 wherein said first leg extends from said vertical flange at an angle of between 100 and 120 degrees.

3. The foundation sill screed of claim 1 including an inside angle between said first leg and said second leg; and said inside angle is between 22 and 42 degrees.

4. The foundation sill screed of claim 1 including a second inside angle between said second leg and said third leg; and said second inside angle is between 82 and 102 degrees.

5. The foundation sill screed of claim 1 including apertures in said vertical flange, said apertures for receiving fasteners therethrough for securing said foundation sill screed to a building.

6. The foundation sill screed of claim 1 wherein said weep apertures are formed longitudinally along said first leg;

said weep apertures in said first leg in linear alignment along said first leg; and said weep apertures situated laterally on said first leg adjacent said vertical flange.

7. The foundation sill screed of claim 6 wherein said second weep apertures are formed longitudinally along said second leg;

said second weep apertures in a one to one relationship with said weep apertures; and each of said second weep apertures in axial alignment with a corresponding weep aperture.

8. The foundation sill screed of claim 1 wherein said foundation sill screed is made of plastic.

* * * * *